US005626652A

United States Patent [19]

Kohl et al.

[11] Patent Number: 5,626,652

[45] Date of Patent: May 6, 1997

[54] LAMINAR FLOW ELECTROSTATIC PRECIPITATOR HAVING A MOVING ELECTRODE

[75] Inventors: Robert E. Kohl, Ellicott City; Paul L. Feldman, Sykesville, both of Md.; Krishnaswamy S. Kumar, Millford, N.J.

[73] Assignee: Environmental Elements Corporation, Baltimore, Md.

[21] Appl. No.: 658,717

[22] Filed: Jun. 5, 1996

[51] Int. Cl.[6] ..... B03C 3/53

[52] U.S. Cl. ..... 96/45; 55/242; 55/DIG. 38; 96/47; 96/49; 96/52; 96/69; 96/94

[58] Field of Search ..... 96/27, 52, 53, 96/74, 61, 69, 44, 45, 94, 39, 47, 49, 50; 95/64–66, 71, 72, 78, 59, 75, 77; 261/112.1; 55/250–242, DIG. 38

[56] References Cited

U.S. PATENT DOCUMENTS

| | | | |
|---|---|---|---|
| 1,250,088 | 12/1917 | Burns | 95/75 |
| 1,329,844 | 2/1920 | Meston | 96/53 X |
| 1,413,993 | 4/1922 | Rhodes | 95/61 |
| 1,944,523 | 11/1934 | Miller | 95/72 |
| 2,497,169 | 2/1950 | Herber et al. | 96/64 |
| 2,648,394 | 8/1953 | Allan | 96/73 |
| 2,711,225 | 6/1955 | Armstrong et al. | 96/62 |
| 3,238,702 | 3/1966 | De Seversky | 96/45 |
| 3,495,379 | 2/1970 | Hall et al. | 95/79 |
| 3,633,337 | 1/1972 | Walker et al. | 55/220 X |
| 3,830,039 | 8/1974 | Ebert et al. | 55/466 X |
| 3,853,750 | 12/1974 | Volsy | 55/418 X |
| 4,072,477 | 2/1978 | Hanson et al. | 55/DIG. 38 |
| 4,189,308 | 2/1980 | Feldman | 95/75 |
| 4,209,306 | 6/1980 | Feldman et al. | 95/80 |
| 4,308,038 | 12/1981 | Michel | 96/47 |
| 4,388,089 | 6/1983 | Reif et al. | 96/45 |
| 4,406,762 | 9/1983 | Ray et al. | 204/157.44 |
| 4,529,418 | 7/1985 | Reif et al. | 96/45 |
| 4,597,780 | 7/1986 | Reif | 55/DIG. 38 |
| 4,908,047 | 3/1990 | Leonard | 55/DIG. 30 |
| 5,009,677 | 4/1991 | Wolf et al. | 95/76 |
| 5,041,145 | 8/1991 | Kakinuma et al. | 96/52 |
| 5,066,316 | 11/1991 | Ikeda | 96/52 |
| 5,084,078 | 1/1992 | Suzuki et al. | 96/52 |
| 5,125,230 | 6/1992 | Leonard | 55/DIG. 30 |
| 5,254,155 | 10/1993 | Mensi | 96/44 |

*Primary Examiner*—Richard L. Chiesa

*Attorney, Agent, or Firm*—Morton J. Rosenberg; David I. Klein

[57] ABSTRACT

An electrostatic precipitation system (100) utilizes laminar flow of a particulate-laden gas in order to enhance the removal of sub-micron sized particulates. The system incorporates a vertically oriented housing (105) through which the gas flows downwardly therethrough to a lower outlet port (110). The gas, which may be a flue gas enters the laminar flow precipitator (102) through an inlet port (108) for passage through a charging section (104). The charging section (104) imparts a charge to the particulates carried by the flue gas. The flue gas and charged particles then flow to a collecting section (106) which is downstream and below the charging section (104). The collecting section (106) is formed by a plurality of substantially parallel tubular members, each tubular member defining a collecting passage therein. Each tubular member (118) is electrically coupled to a potential that is of opposite polarity to that imparted to the particulates, so as to attract the charged particulates to an inner surface thereof. The collected particulates are subsequently collected in a hopper (112) or reetrained in the gas stream as agglomerates for subsequent removal from the gas by a secondary filter, the gas stream then being conveyed to a stack (14) wherein the particulate-free gas can be emitted into the atmosphere.

20 Claims, 4 Drawing Sheets

LAMINAR FLOW ELECTROSTATIC PRECIPITATOR HAVING A MOVING ELECTRODE

BACKGROUND OF THE INVENTION

1. Field of the Invention

This invention directs itself to an electrostatic precipitation system wherein 100% particulate removal can practically be achieved. In particular, this invention directs itself to an electrostatic precipitation system having a laminar flow precipitator. To achieve laminar flow, the precipitator is divided into a charging section for imparting a charge to the particulates carried in a gas stream and a collecting section having a moving electrode disposed at a potential that is different from that of the charged particles, for attracting the charged particles thereto. More in particular, this invention pertains to a collecting section of a precipitator formed by a plurality of substantially parallel collecting passages, each passage being formed by a tubular member which is electrically coupled to a reference potential and in which a conductive fluid film coats an inner surface thereof and flows downwardly at substantially the same rate as the gas stream. Further, this invention directs itself to a laminar flow precipitator wherein the charging section and collecting section share a common reference potential electrode formed by a flowing fluid film, wherein the charging portion thereof is provided with a corona discharge and the collecting portion thereof is devoid of corona discharge.

2. Prior Art

The governmental requirements for preventing the emission of hazardous air pollutants is continually being made more stringent. Most prominent of the air pollutants being restricted, are toxic trace metals and their compounds. These compounds primarily exist in the form of particulate matter. Due to the nature of particulate formation in combustion processes, many of the trace metals, such as arsenic, cadmium, nickel, etc., as well as the high-boiling point organic hazardous air pollutants tend to concentrate on the fine, sub-micron sized particulates present in a flue gas. The problem of control of toxic trace metals and heavy organic pollutants therefore becomes largely a problem of fine particulate control. Other governmental regulations with respect to air emissions require control of sub-micron sized particles, as well.

Conventional collectors, electrostatic precipitators and fabric filters, are very capable of fine particulate control, but as the government requirements exceed 99.9%, they have difficulty in delivering consistent reliable performance, especially for the respirable particles in the 0.2 to 0.5 micron range. As the government regulations become more stringent, adequate control of toxic emissions will require particulate collection efficiencies of 99.95% or greater.

Conventional industrial electrostatic precipitators collect dry particulates in a parallel plate, horizontal flow, negative-polarity, single-stage system design. Collecting plate spacing generally ranges from 9 to 16 inches, and plate height can be up to 50 feet. Flow through the precipitator is always well into the turbulent range. Due to the turbulent flow, precipitator collection efficiency is predicted utilizing the Deutsch model, which assumes that the turbulence causes complete mixing of the particles in the turbulent core of the flow gas, and electrical forces are operative only across the laminar boundary layer. This model leads to an exponential equation relating collection efficiency to the product of the electrical migration velocity of the particles and the specific collecting area of the precipitator. The exponential nature of the equation means that increasing of the specific collecting area yields diminishing returns in the efficiency at the high collection efficiency levels. Therefore, the 100% collection efficiency level is approached only asymptotically in the turbulent flow case and cannot in actuality be reached, no matter how large the precipitator.

It has long been known that laminar flow precipitation provides many advantages over turbulent flow. In laminar flow, the flow stream lines are parallel and in the direction of flow; there is no force causing particles near the collecting surface to be thrown back into the central flow region. Therefore, the electrical forces tending to move the particles toward the collecting surface are effective across the entire flow cross-section, not just across the laminar sublayer. As a result, the equation which relates collection efficiency to the product of the electrical migration velocity of the particles and the specific collecting area defines a linear relationship, whereby collection efficiency is possible.

Besides the practical achievement of 100% collection efficiency, equivalent efficiencies in a laminar flow system can be achieved with a significantly smaller specific collecting area. The striking difference between the collection efficiencies of laminar flow, versus turbulent flow can be seen utilizing a typical utility fly ash emission system, calculating the specific collecting area (in square feet per thousand acfm) versus collection efficiency in two cases. In a turbulent flow system a specific collecting area of 230 is determined to be required at 99% collection efficiency, and is calculated to be over 800 at 99.99%. In a laminar flow calculation, on the other hand, the specific collecting area requirement is determined to range from 100 at 99% efficiency to only 160 at 99.99%. Thus, a turbulent flow precipitator is more than twice the size of an equivalent laminar flow precipitator at 99% collection efficiency and at 99.99% efficiency the turbulent flow precipitator must be more than five times larger than an equivalent laminar flow system. Although the advantages of laminar flow precipitation have been known, prior attempts to incorporate those principles into a working system have been unsuccessful or impractical for industrial scale applications. A major obstacle to achieving laminar flow in such systems has been the turbulence introduced by the corona discharge of the precipitator itself. When the charging section is separated from the collecting section, the holding force of the collecting section is reduced. However, the instant invention utilizes a substantially vertically and downwardly directed gas flow in combination with a two stage electrostatic precipitator design having separate charging and collecting sections with a moving electrode to achieve a practical laminar flow electrostatic precipitation system and collect the particulates from the gas stream, the moving electrode being formed by a conductive fluid flowing within each of a plurality of collection passages.

The best prior art known to the Applicants include U.S. Pat. Nos.: 1,329,844; 1,413,993; 1,944,523; 2,497,169; 2,648,394; 2,711,225; 3,495,379; 3,633,337; 3,830,039; 3,853,750; 4,072,477; 4,908,047; 5,009,677; 5,125,230; and, 5,254,155.

In some prior art systems, such as that shown in U.S. Pat. No. 5,254,155, an electrostatic precipitator system is disclosed wherein a single-stage structure is provided. Such systems provide a plurality of passageways that are defined by a honeycomb structure for gas flow upwardly therethrough. Stationary rods extend into each passageway, the rods being coupled to the negative output of a power supply, while the walls of the honeycomb passageways are coupled to a reference potential. Removal of the collected particulates is accomplished by washing them downwardly utilizing a liquid mist (water) collected from the gas stream. The liquid mist is introduced into the gas flow upstream of the electrostatic precipitator electrodes, and is introduced solely for cleaning contaminants from the collecting electrodes. Since a corona discharge is maintained throughout the length of the honeycomb passages, laminar gas flow is not achieved. Further, since the water flows in a direction opposite to that of the gas stream, there cannot be a net zero velocity between their respective flow rates.

In other systems, such as that disclosed by U.S. Pat. No. 2,648,394, the gas to be cleaned flows downwardly through a housing in order to be directed upwardly through the precipitator, which is defined by a plurality of tubular members having centrally disposed electrodes extending axially therethrough. Here again, a single-stage system is provided wherein laminar flow of the gas is not achieved. Spray nozzles are also provided for introducing water droplets into the gas inlet conduits which serve to flush deposited material out of the tubular members. Again, the water flow is opposite that of the gas flow and thus cannot contribute to producing a laminar flow of the gas.

In other systems, like those shown in U.S. Pat. Nos. 5,009,677 and 2,497,169, single-stage electrostatic precipitators are formed utilizing a plurality of vertically oriented tubular collecting electrodes through which a discharge electrode extends axially therethrough, for establishing a corona discharge throughout the length of the tubular electrode.

None of these prior art systems direct themselves to achieving laminar flow of the particulate-laden gas. Additionally, these prior art systems do not direct the gas downwardly through electrostatic tubular collecting electrodes which are devoid of corona discharge. Further, none of these prior art systems disclose or suggest the use of a conductive fluid film as a moving collection electrode to attract and carry away particulates while simultaneously contributing to the establishment of laminar flow of the gas, and thereby result in a less efficient system than that provided by the instant invention.

SUMMARY OF THE INVENTION

A laminar flow electrostatic precipitator is provided. The precipitator includes a housing having at least a portion thereof being longitudinally extended. The longitudinally extended portion of the housing is oriented in a vertical direction. The housing has a gas inlet disposed at an upper end thereof and a gas outlet disposed at a lower end of the longitudinally extended portion. The precipitator further includes a power source having a first output for supplying a reference potential and a second output for supplying a potential that is of a polarity opposite with respect to the reference potential. The precipitator further includes a charging assembly disposed within the housing in fluid communication with the gas inlet for flow of the gas having entrained particulates therein. The charging assembly is coupled to the first and second outputs of the power supply for imparting a charge to the entrained particulates. The precipitator further includes a collecting assembly disposed within the longitudinally extended portion of a housing downstream of the charging assembly for providing laminar flow of the gas therethrough and attraction and removal of charged particulates from the gas. The collecting assembly includes a plurality of parallel collection passages for gas flow therethrough. Each of the collection passages has a moving collection electrode disposed therein. Each of the moving electrodes is displaced at a rate substantially equal to a flow rate of the gas, and each of the moving electrodes are coupled to the first output of the source supply for attracting and carrying away charged particulates.

DESCRIPTION OF THE PREFERRED EMBODIMENTS

Referring now to FIGS. 1–7, there is shown electrostatic precipitation system 100 for removing particulates, including fines, sub-micron sized particles, from an emission source. As will be seen in following paragraphs, electrostatic precipitation system 100 incorporates a novel laminar flow precipitator 102 capable of 100% collection efficiency. The novel features of laminar flow precipitator 102 make it suitable for incorporation into precipitation systems requiring very high particulate removal efficiencies.

Figure 1:
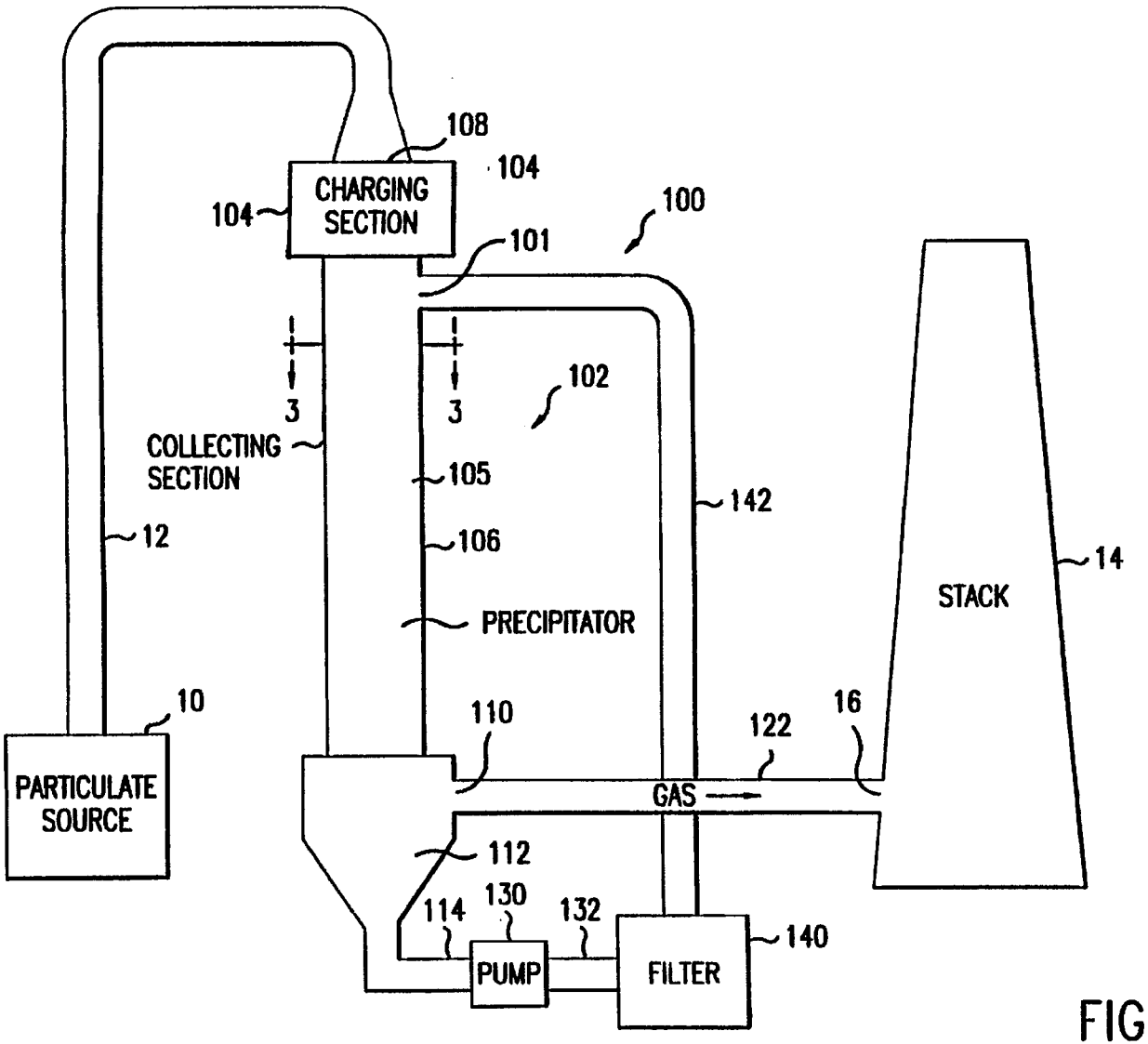
FIG. 1 is a block diagram of a system using one embodiment of the present invention.

Referring to FIG. 1, there is shown, electrostatic precipitation system 100 coupled in-line between a source 10 of particulates entrained in a gas and a stack 14 for emission of the gas to the atmosphere. Although the source of particulates 10 may be any type of source, such sources include coal or oil fired furnaces or boilers, various types of incinerators, and any combustion process wherein hazardous air pollutants in the form of particulate matter are produced. As a coal fired furnace, for example, the source 10 has a flue pipe 12 which is coupled to the gas inlet 108 of the laminar flow precipitator's vertically oriented housing 105.

The particulates entrained in the flue gas entering the precipitator 102 through the inlet 108 must first be charged before they can be removed by electrostatic attraction, as such is the principal upon which all electrostatic precipitators operate. Such charging can be negative or positive, however, negative charging is more widely used. Precipitator 102 is specifically designed to create a laminar flow of flue gas in order to increase the efficiency of particulate removal. The particulates are charged as they pass through a corona discharge established between one or more pairs of parallel or concentric electrodes. The corona discharge which is necessary to efficiently impart the desired charge to the particulates to be removed, creates a "corona wind" which produces a turbulent flow in the gas pattern passing through the precipitator. Therefore, precipitator 102 is designed to separate the charging zone of the precipitator from the collection zone, the collection zone being enhanced by laminar flow of the gas flowing therethrough and formed by novel means.

As shown in FIG. 1, the precipitator 102 is provided with a charging section 104 disposed upstream of the collecting section 106, wherein the flue gas entering the inlet 108 passes through charging section 104 and collection section 106 to then pass through the gas outlet 110. Particulates removed in collecting section 106 are subsequently carried to the particulate removal hopper 112 by a moving fluid electrode. The waste materials and fluid are collected and appropriately processed to separate the waste products from the fluid. The particulates collected in collecting section 106 are carried down to the hopper 112 by a fluid such as water. The water is supplied through a water inlet 101 to flow down through the collecting section 106 into hopper 112 and carry the collected particulates therewith and serve as a moving collection electrode, as will be further described in following paragraphs. The water collected in hopper 112 is supplied to a pump 130 by a conduit 114. The water, carrying the particulates, is pumped to a filter 140 through a conduit 132. The filter 140 separates the particulates from the water, directing the particulate-free water to the inlet 101 through the return conduit 142.

The separation of the collecting section from the charging section results in a weaker electrostatic force between charged particulates and the collecting electrodes. The downward flow of fluid captures the particulates and prevents the reentrainment of the collected particles into the gas stream. The particulate-free gas flows from the outlet 110 to the inlet 16 of the stack 14 through a conduit 112.

The laminar flow through collecting section 106 is achieved in-part by passing the gas through a plurality of substantially parallel collecting tubes having a predetermined diameter and at a predetermined velocity, approximately five feet per second, downstream of the charging section 104 to achieve a Reynolds number less than 2,000. The well established Reynolds number is a dimensionless factor represented by the equation:

$$Re = \frac{Dv}{v}$$

where:

D is the diameter of the tubes,

V is the mean velocity of the fluid, v is the kinematic viscosity of the fluid.

To achieve laminar flow, RE<2,000 must be satisfied. By moving the boundary with the gas, at substantially the same velocity, the mean velocity becomes zero, Re becomes zero and the conditions for laminar flow are thereby satisfied.

Figure 3:
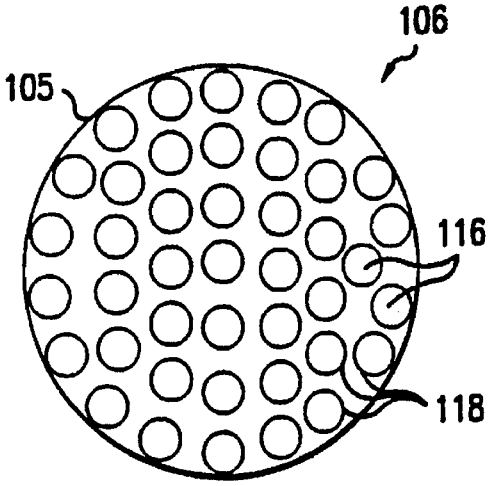
FIG. 3 is a sectional view of the collecting section portion of the present invention taken along the section line 3—3 of FIG. 1.
Figure 4:
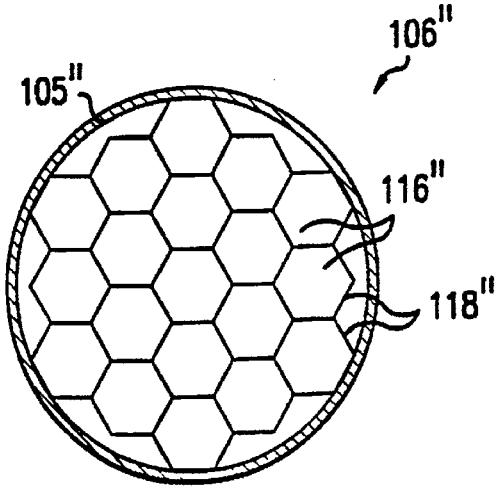
FIG. 4 is a sectional view of an alternate embodiment of the collecting section shown in FIG. 3.

As shown in FIG. 3, the collecting section 106 is formed by a plurality of collecting passages 106, the collecting passages being formed by respective tubular collecting members 118. In this particular embodiment, each of the tubular members 118 has a circular cross-sectional contour, but other shapes may be utilized and still obtain laminar flow. As shown in the alternate embodiment of FIG. 4, the collecting section 106" includes a plurality of collection passages 116" disposed within the vertical housing 105". Each of the collecting spaces 116" are formed by a polygonal tubular collecting member 118". In particular, the honeycomb-like structure of collecting section 106" is formed by a plurality of hexagonal tubular members. As a result of the moving electrode feature, the size of the collection passages 116, 116" is not critical to achieving laminar flow, since the moving electrode eliminates drag at the passage boundaries.

Figure 2:
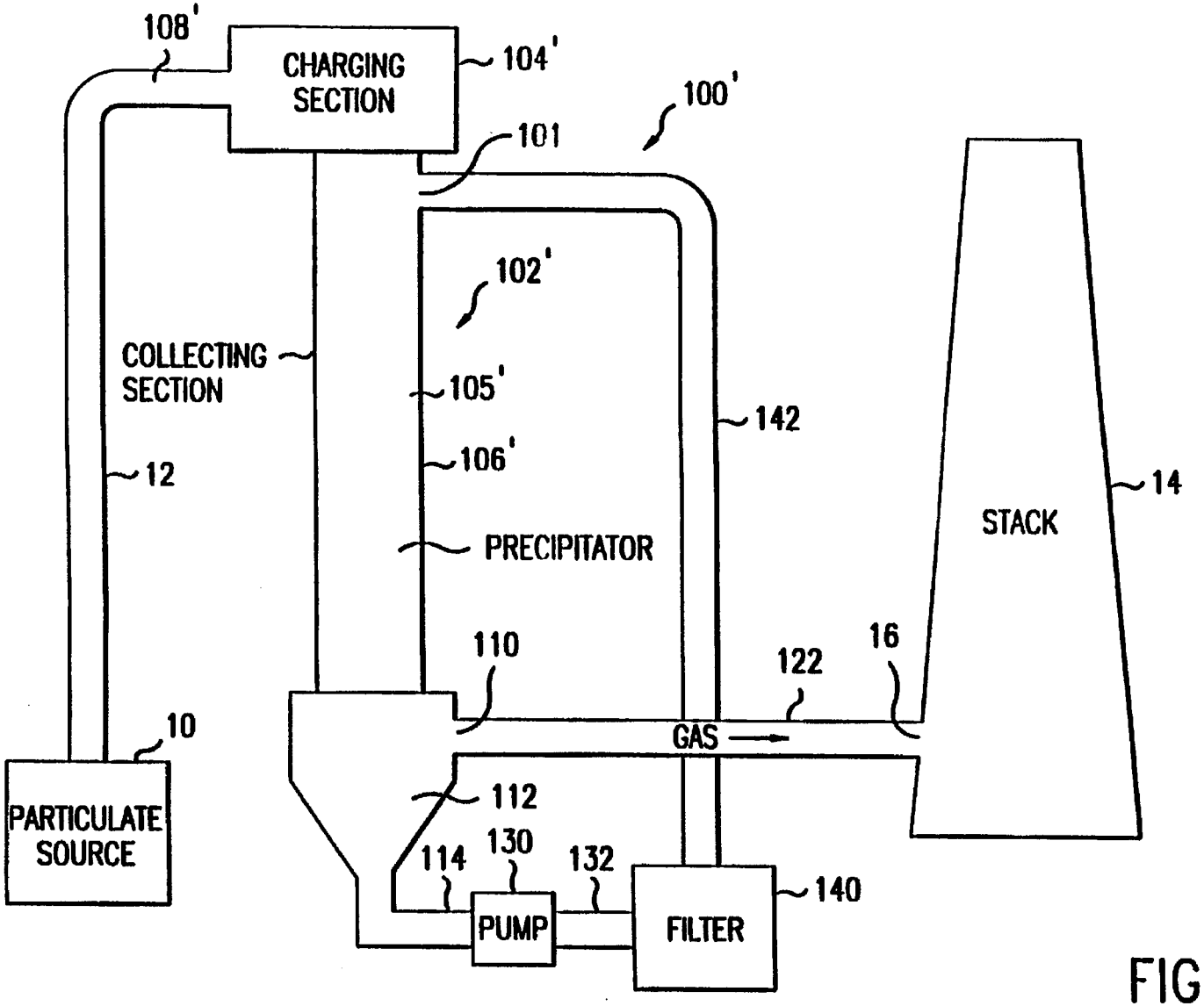
FIG. 2 is a block diagram of a system using an alternate configuration of the present invention.

Referring now to FIG. 2, there is shown, the electrostatic precipitation system 100'. As in the first embodiment, the outlet of a particulate source 10, such as a coal-fired furnace, is coupled to a flue 12 which brings the flue gas and entrained particulates to the precipitator inlet 108'. The flue gas and entrained particulates flow through a charging section 104' before flowing downwardly through a vertically oriented housing portion 105' of the laminar flow precipitator 102'. The vertically oriented housing 105' encloses the collecting section 106' for removing the particulates entrained in the flue gas. The particulate-free gas flows from an outlet 110 through a conduit 122 to the inlet 16 of the stack 14 for passage therethrough into the environment. The collecting section 106' includes a plurality of parallel passageways, and a system for circulating fluid through the collecting section for carrying off the particulates removed from the gas stream. An electrically conductive fluid, such as water, enters the vertical housing portion 105' of precipitator 102' through an inlet 101, and directed to flow through the plurality of parallel collecting passages contained therein, like those shown in FIG. 3 or FIG. 4 to serve as an electrode and carry away particulates. The particulate-laden water is collected in the hopper 112 and flows to a pump 130 through a conduit 114. Pump 130 displaces the water through a conduit 132 to a filter 140, wherein the particulates are removed from the water and clean water flows through a conduit 142 back to the inlet 101. As will be seen in following paragraphs, the downward flow of both the gas stream and conductive fluid is important to the achievement of laminar flow of the gas stream through the collecting section 106, 106'.

The laminar flow precipitator 102, 102' is a two stage structure wherein the charging section 104, 104' may be oriented for downward vertical flow, as shown in FIG. 1, or oriented for horizontal flow as shown in FIG. 2. However, the collecting section 106, 106' is provided in a vertically oriented housing 105, 105' wherein the particulate-laden gas is directed to flow downwardly through a plurality of substantially parallel collecting passages, each having a moving collection electrode. Both the charging section 104, 104' and the collecting section 106, 106' may be formed in any of several different arrangements, however, it is important that the collecting section not be subject to corona discharge, as such would create turbulence and inhibit achieving laminar flow therethrough.

Figure 5:
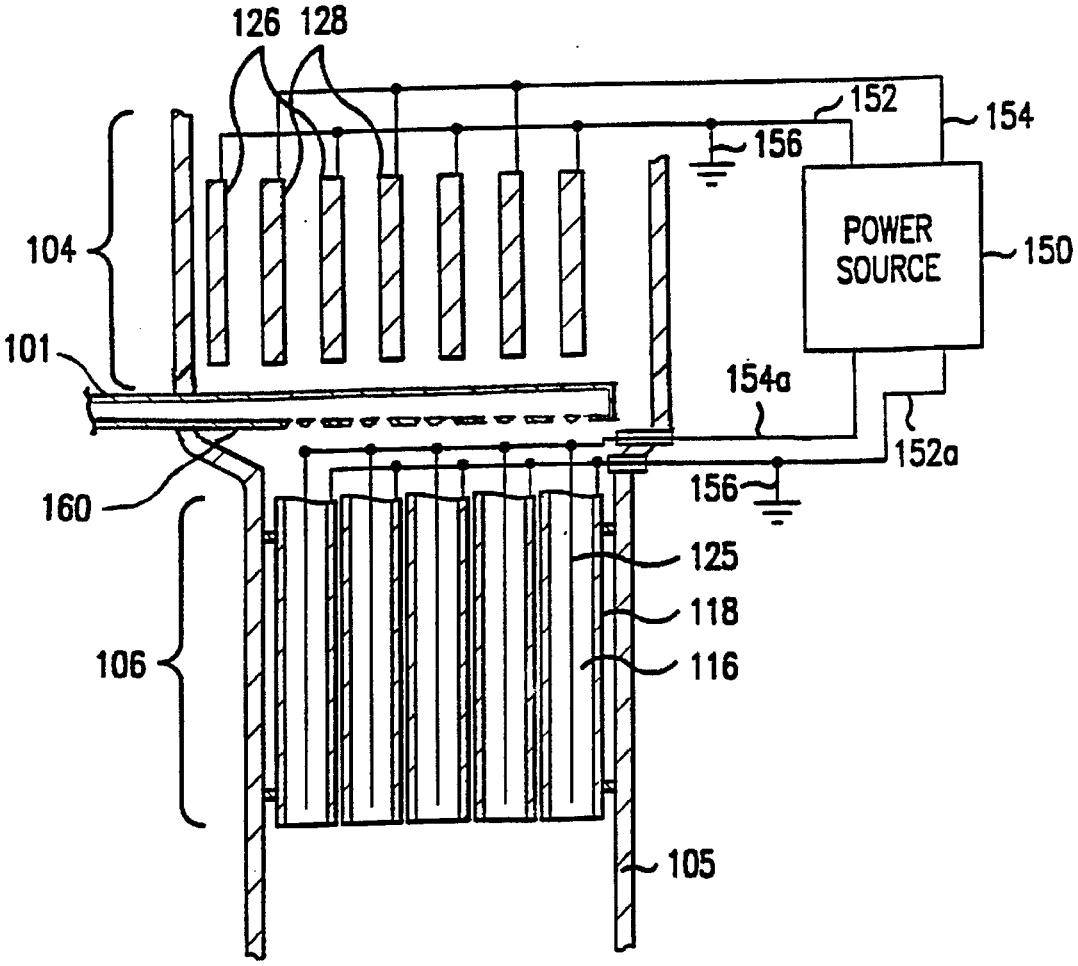
FIG. 5 is a cross-sectional elevation view of the charging and collecting sections of the present invention showing the electrical connection thereof.

As shown in FIG. 5, the charging section 104 may be formed by a plurality of parallel electrodes 126, 128 which are respectively coupled to the reference voltage output line 152 and negative voltage output line 154 of the high voltage power source 150 for imparting a negative charge to the entrained particulates. If it is desired to impart a positive charge, a power source 150 having an output line 154 which was positive with respect to the output line 152 would be used. Power source 150 may represent multiple power supplies, with different power supplies being coupled to different sections of the precipitator 102, 102'. The reference voltage output line 152 is coupled to the ground reference terminal 156 so that the high voltage potential supplied on line 154 is more negative than the ground reference level, to impart the appropriate negative charge on particulates passing between the respective electrodes 126, 128. It should be understood that other configurations of the charging section 104 may be utilized in the laminar flow precipitator 102, 102' without departing from the inventive concepts embodied herein. As previously discussed, the collecting section 106 is formed by a plurality of tubular collecting members 118, each having a predetermined diameter or width dimension. The water, which may have its conductivity adjusted by the addition of ionic compounds, as is well known in the art, is supplied to inlet 101. The water is distributed to the plurality of tubular collecting members 118 by a manifold 160. Manifold 160 is provided with a plurality of orifices for delivering the fluid to the inner wall surface of each tubular member 118. The water forms a film layer 168 on the inner surface of each tubular member which flows downwardly thereon at a rate of approximately 5 feet per second. Fluids other than water may also be used, including fluidized metallic powders.

Each tubular member 118 defines a respective collecting passage 116 through which the gas charged particles and water pass. Each of the tubular members 118 is formed of a conductive material, and electrically connected to the reference voltage output line 152*a* of power source 150, which is referenced to ground potential by connection to ground terminal 156. The water, being conductive and in contact with the collecting tubes is likewise electrically coupled to output line 152*a*. As the conductive fluid is coupled to the reference potential, and the charged particulates are charged more negatively, the particles are attracted to the fluid film 168 flowing down the inner wall surfaces of the tubes 118. A non-discharging electrode 125 extends concentrically within each collecting passage 116. Each electrode 125 may have a cylindrical configuration of predetermined diameter, and each is electrically coupled to the voltage output line 154*a*. Electrode 125 may be in the form of a wire-like electrode or other rod-like member, devoid of sharp corners or edges which could result in high electric field concentrations. The diameter of each electrode 125 and the voltage applied thereto is selected to maximize an electric field within each respective space 116 without creating sparking or corona discharge. Laminar flow is achieved for gas velocities in the approximate range of the flow rate of the fluid, providing a net flow rate difference of approximately zero. The size of the collecting passages 116 may become more critical where the difference in flow rates between the gas and water becomes more substantial.

Figure 6:
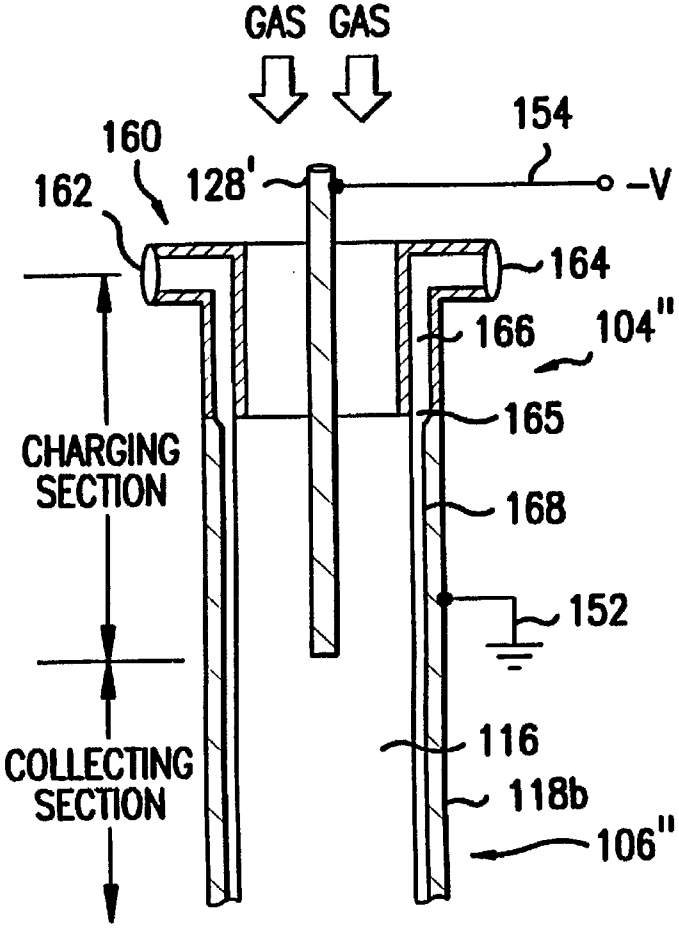
FIG. 6 is a cross-sectional elevation view of an integrated charging and collecting section of the present invention; and, FIG. 7 is a cross-sectional elevation view of another embodiment of an integrated charging and collecting section of the present invention.

Referring now to FIG. 6, there is shown an alternate configuration for the two stage laminar flow precipitator. FIG. 6 shows an electrode configuration of one of the plurality of collection passages wherein the charging section 104" is integrated with the collecting section 106" to have one electrode 118, 168 in common therebetween. A rod-shaped electrode 128' is electrically coupled to the negative voltage output 154 of the power source. The electrode 128' extends a predetermined distance into the collection passage 116, the electrode being centrally located within the passage 116 in concentric relationship with the tubular member 118. The tubular member 118 is electrically coupled to the power source output line 152 and a conductive fluid film flows down the inner surface thereof. The distance that the electrode 128' extends into the tubular member 118 defines the charging section 104". The voltage applied between the electrodes 168 and 128', and the spacing therebetween being selected to establish a corona discharge between electrode 128' and the conductive fluid film flowing down an upper portion of the tubular member 118*a*, for charging the particulates being carried by the flowing gas. The remainder 118*b* of the tubular member 118 defines the collection section 106", the conductive fluid flowing thereon defining a collection electrode with the charged particles being attracted to the fluid film 168 and being carried away thereby.

The upper ends of each tubular member 118 are coupled to the manifold 160 for dispensing the conductive fluid to the inner surface of the tubular member. The manifold, as described herein, is exemplary only and other means for distributing the fluid to the inner surface of the tubular members may be used. Such means for distributing the fluid may be dictated by the type of fluid being used, such as when a fluidized metallic powder is employed. The portion of manifold 160 shown has an inlet passage 162 through which the fluid passes to flow into an annular passage 166. From annular passage 166, the fluid flows down through an annular orifice 165, as well as through an outlet passage 164 for passage to other portions of manifold 160. The fluid passing through orifice 165 flows over the inner surface of the tubular member 118 to form the conductive film layer 168. The conductive fluid film layer will have the potential and polarity of the reference voltage, and thereby attract the charged particulates thereto and carry them to the hopper 112. Since the fluid is flowing downward, it defines a moving electrode, an electrode that moves with the gas stream, which is also moving downward. This arrangement is conducive to laminar flow since drag between the gas and the electrode surface is reduced by virtue of their flow rates being substantially the same. Even where the gas flow rate is greater, the differential flow rate is reduced over that which would result if a fluid electrode were not used. The fluid film 168 also serves to carry off the attracted particulates and prevent their reentrainment into the gas stream.

Figure 7:
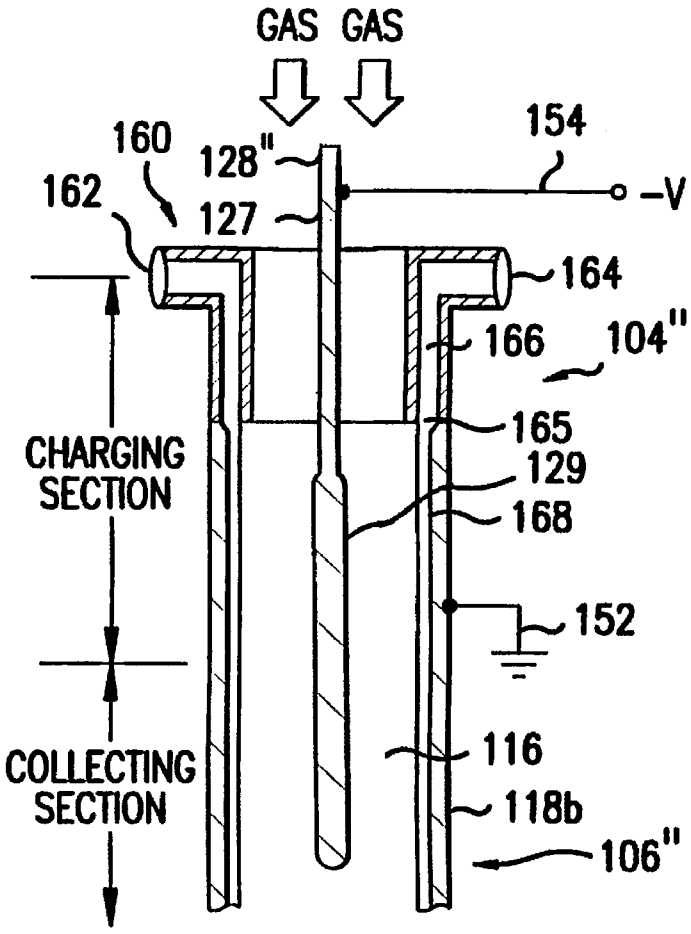

Another configuration for an integrated two stage laminar flow precipitator is shown in FIG. 7 represented by one of the plurality of collection passages. In this embodiment the electrode 128" is coupled to the negative voltage output line 154 and extends concentrically within the passage 116 defined by the tubular member 118. The upper portion 127 of electrode 128" is of a smaller diameter than the lower portion 129, and thereby concentrates the electric field lines directed to the reference electrode fluid film layer 168 on portion 118*a* of the charging section 104" as a result of its smaller surface area. The upper portion 127 of electrode 128" is dimensioned so as to induce corona discharge between the fluid film layer 168 and the electrode portion 127 at the applied voltage level. In order to increase the holding force between the charged particles and the collection electrode defined by the fluid flowing through portion 118*b*, the negative electrode 128" is designed to extend a predetermined distance into the collection section 106". However, as previously discussed, corona discharge creates turbulence which would inhibit laminar flow through the collection section. Thus, the lower portion 129 of electrode 128" is dimensioned differently than that of the upper portion 127, such being dimensioned to increase the surface area of the portion 129 to reduce the concentration of electric field lines, as compared to upper portion 127, directed to the fluid film layer 168 to prevent corona discharge therebetween. Thus, the combination of electrode portion 129 and the conductive fluid film layer 168 flowing through portion 118*b* provide an electrostatic field for increasing the electrical field between the charged particles and the fluid film layer 168, without the generation of corona discharge. In this configuration, the manifold 160 is coupled to the tubular member 118 to distribute the conductive fluid to the inner surface thereof, through the orifice 165, as in the embodiment of FIG. 6.

Thus, by providing a precipitator having a collecting section 106, 106+, 106" disposed within a vertically oriented housing 105, 105' for flow of a particulate-laden gas downwardly therethrough, with the gas flow being directed at a predetermined rate through a plurality of collecting passages 116, 116" devoid of corona discharge and having a conductive fluid electrode flowing downward along the boundary of the collecting passages 116, 116", a laminar flow of the gas is achieved. With the collecting passages being formed by a plurality of tubular members 118, 118" which are electrically coupled to a reference voltage output line 152 of a power source 150, and having a conductive fluid film layer 168 flowing thereon, charged particulates entrained in the gas will be attracted to the fluid and removed from the downwardly flowing gas. Since corona discharge creates a turbulence which would prevent laminar flow, the particulates entrained in the gas are charged in a separate charging section 104, 104+, 104" disposed upstream of the collecting section. The charging section may take the form of spaced parallel plates, or may be integrated into an upper portion 118*a* of the respective tubular members 118, 118". Since the conductive fluid defines an electrode moving in the same direction as the gas and approximately at the same flow rate, drag therebetween is eliminated, or at least reduced, a practical laminar flow precipitator is thereby realized, and accordingly 100% particulate removal can be achieved.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A laminar flow electrostatic precipitator, comprising:

a housing having at least a portion thereof being longitudinally extended, said longitudinally extended portion being oriented in a vertical direction, said housing having a gas inlet disposed at an upper end thereof and a gas outlet disposed at a lower end of said longitudinally extended portion;

a power source having a first output for supplying a reference potential and a second output for supplying a potential that is of a polarity opposite with respect to said reference potential;

charging means disposed within said housing in fluid communication with said gas inlet for flow of a gas having entrained particulates therein, said charging means being coupled to said first and second outputs of said power source for imparting a charge to the entrained particulates; and, collecting means disposed within said longitudinally extended portion of said housing downstream of said charging means for providing laminar flow of the gas therethrough and attraction and removal of charged particulates from the gas, said collecting means including a plurality of parallel collection passages for gas flow therethrough, each of said collection passages having a moving collection electrode disposed therein, each of said moving electrodes being displaced at a rate substantially equal to a flow rate of the gas, each of said moving electrodes being coupled to said first output of said power source for attracting and carrying away charged particulates.

2. The laminar flow electrostatic precipitator as recited in claim 1 where each of said collection passages is formed by a longitudinally extended tubular member.

3. The laminar flow electrostatic precipitator as recited in claim 2 where said moving collection electrodes are formed by a conductive fluid continuously supplied to said collecting means for downward flow through each of said tubular members.

4. The laminar flow electrostatic precipitator as recited in claim 3 where said conductive fluid is water.

5. The laminar flow electrostatic precipitator as recited in claim 3 where said housing includes a liquid outlet port formed in said lower end of said longitudinally extended portion of said housing for flow of said conductive fluid therethrough.

6. The electrostatic precipitation system as recited in claim 3 where said charging means includes a plurality of rod-shaped electrodes coupled to said second output of said power source, each of said plurality of rod-shaped electrodes being at least partially disposed within a first portion of a respective one of said plurality of collection passages and in parallel spaced relation with a portion of a respective moving collection electrode.

7. The electrostatic precipitation system as recited in claim 6 where each of said plurality of rod-shaped electrodes has a first diameter portion and a second diameter portion, said first diameter portion extending a first predetermined distance within a respective collection passage and having a predetermined diameter selected to produce corona discharge therein, said second diameter portion extending a second predetermined distance within said collection passage beyond said first predetermined distance and having a predetermined diameter selected to discourage corona discharge formation therein while increasing an electrostatic holding force of said moving collection electrode.

8. The laminar flow electrostatic precipitator as recited in claim 3 where each of said tubular members has a circular cross-sectional contour.

9. The laminar flow electrostatic precipitator as recited in claim 3 where each of said tubular members has a polygonal cross-sectional contour.

10. The electrostatic precipitation system as recited in claim 3 where said charging means is formed by a plurality of parallel plate electrodes.

11. The laminar flow electrostatic precipitator as recited in claim 4 where said water forms a moving conductive film layer flowing downwardly through each respective tubular member.

12. The laminar flow electrostatic precipitator as recited in claim 5 further comprising filter means coupled in fluid communication with said liquid outlet port for removing collected particulates from said conductive fluid.

13. A laminar flow electrostatic precipitator, comprising:

a housing having a longitudinal axis oriented in a vertical direction, said housing having a gas inlet disposed at an upper end thereof and a gas outlet disposed at an opposing lower end;

a power source having a first output for supplying a reference potential and a second output for supplying a potential that is of a polarity opposite with respect to said reference potential;

charging means disposed within said housing and coupled in fluid communication with said gas inlet for flow of a gas having entrained particulates therein, said charging means being coupled to said first and second outputs of said power source for imparting a charge to the entrained particulates; and, collecting means disposed within said housing downstream of said charging section for providing laminar flow of the gas therethrough and attraction and removal of charged particulates from the gas, said collecting means including moving collection electrode means electrically coupled to said first output of said power source for attracting and carrying away charged particulates, said moving collection electrode means being displaced at substantially the same speed as a flow rate of the gas and in substantially the same direction.

14. The laminar flow electrostatic precipitator as recited in claim 13 where said collecting means includes a plurality of substantially parallel collecting passages.

15. The laminar flow electrostatic precipitator as recited in claim 14 where said plurality of collecting passages are formed by a plurality of substantially parallel electrodes, each of said plurality of electrodes being electrically coupled to said first output of said power source.

16. The laminar flow electrostatic precipitator as recited in claim 15 where said moving collection electrode means includes a conductive fluid continuously supplied to said plurality of collecting passages.

17. The laminar flow electrostatic precipitator as recited in claim 16 where each of said plurality of electrodes is formed by a tubular collection member.

18. The laminar flow electrostatic precipitator as recited in claim 17 where each of said tubular collection members has a circular cross-sectional contour.

19. The laminar flow electrostatic precipitator as recited in claim 17 where each of said tubular collection members has a polygonal cross-sectional contour.

20. The laminar flow electrostatic precipitator as recited in claim 17 where said conductive fluid forms a moving conductive film layer flowing downwardly through each respective tubular collection member.

* * * * *